US008313276B2

(12) United States Patent
Schmidkonz

(10) Patent No.: US 8,313,276 B2
(45) Date of Patent: Nov. 20, 2012

(54) METHOD AND DEVICE FOR THE SOFTWARE-CONTROLLED PRODUCTION OF BOOK COVERS FOR INDIVIDUAL BOOKS AND SHORT RUNS OF DIFFERENT FORMAT SIZES

(76) Inventor: Peter Schmidkonz, Nittenau (DE)

( * ) Notice: Subject to any disclaimer, the term of this patent is extended or adjusted under 35 U.S.C. 154(b) by 432 days.

(21) Appl. No.: 12/450,884

(22) PCT Filed: Apr. 11, 2008

(86) PCT No.: PCT/DE2008/000611

§ 371 (c)(1),
(2), (4) Date: Oct. 16, 2009

(87) PCT Pub. No.: WO2008/135007

PCT Pub. Date: Nov. 13, 2008

(65) Prior Publication Data

US 2010/0111643 A1 May 6, 2010

(30) Foreign Application Priority Data

Apr. 17, 2007 (DE) ..... 10 2007 018 023

(51) Int. Cl.
*B42C 7/00* (2006.01)
*B42C 9/00* (2006.01)
*B42C 11/00* (2006.01)

(52) U.S. Cl. ..... 412/3; 412/1; 412/4; 412/5

(58) Field of Classification Search ..... 412/3, 17
See application file for complete search history.

(56) References Cited

U.S. PATENT DOCUMENTS

| | | | | |
|---|---|---|---|---|
| 2,596,068 | A * | 5/1952 | Bunch et al. | 412/17 |
| 4,377,430 | A * | 3/1983 | Bexley et al. | 412/3 |
| 5,308,208 | A * | 5/1994 | Ranson | 412/3 |
| 5,413,446 | A * | 5/1995 | Rathert et al. | 412/17 |
| 6,206,358 | B1 * | 3/2001 | Yamaguchi et al. | 412/11 |
| 6,669,429 | B2 * | 12/2003 | Beermann et al. | 412/19 |
| 7,236,934 | B1 * | 6/2007 | Mayes | 412/17 |
| 7,478,988 | B2 * | 1/2009 | Porat | 412/3 |

FOREIGN PATENT DOCUMENTS

| | | |
|---|---|---|
| DE | 31 09 114 | 9/1982 |
| DE | 201 09 230 | 9/2001 |
| DE | 103 55 252 | 6/2005 |
| EP | 0 343 522 | 11/1989 |

OTHER PUBLICATIONS

DE 10355252 Translation (DE 10355252 in IDS).*

* cited by examiner

*Primary Examiner* — Edward Tolan
*Assistant Examiner* — Kyle Grabowski
(74) *Attorney, Agent, or Firm* — Welsh Flaxman & Gitler LLC

(57) ABSTRACT

For the automatic production of book covers for individual books with different format sizes, the data of the book to be bound are acquired and cataloged using software, the book covers are cut to the desired format, covering materials adapted to the format are applied to the book cover, the corners are folded, the endpapers are applied to the book covers and the text block and book cover are joined together, precisely positioned.

7 Claims, 2 Drawing Sheets

METHOD AND DEVICE FOR THE SOFTWARE-CONTROLLED PRODUCTION OF BOOK COVERS FOR INDIVIDUAL BOOKS AND SHORT RUNS OF DIFFERENT FORMAT SIZES

BACKGROUND OF THE INVENTION

The invention relates to the software-controlled production of book covers for individual books and short runs with dimensions that change from book to book, using a book cover production machine with individually designed and fully automatic adjustable single components.

Machines and systems for the production of covers for hardbound books with book covers are known in the art, by means of which book covers with the same dimensions are manufactured using identical format blanks made of paperboard or cardboard for the book boards and spine inlay and corresponding covering material. Accordingly, the rigid specifications for the machine setup have to be changed with each change in the format size of a book cover, resulting in interruption of the production process, and the manual or automatic adjustments of the machine have to be made for adaptation to the new format. This results in a time-consuming process for the machine setup, which in practice means that the automatic production of individual books and short runs is neither technically nor economically feasible with such machines or systems, which due to the rigid specification of the format size for the book covers are necessarily suitable only for the mass production of books in large quantities. The relatively frequent resetting of such known machines for high production quantities involves the further disadvantage that defective copies frequently have to be reckoned with due to the startup of the machine, so that also for this reason the production of individual copies or short runs, in particular in the case of book covering materials with print designs that change from one copy to the next, such as in the case of photo books, is out of the question.

It is an object of the present invention is to provide a method and a device for the automatic production of individual books and short runs with changing cover printing, variable format sizes and printed designs in the book covering materials that change from book to book, in particular for photo books, which can be produced with minimal personnel requirements and at accordingly low cost, as well as with minimal time requirements.

SUMMARY OF THE INVENTION

According to the invention, this object is achieved with a method wherein the text block, cover and covering material, as well as their constituent parts, are manufactured based on identical data, and that the book cover, text block and covering material are automatically adapted to each other so that a particular book cover is allocated to a particular covering material in a software-controlled process.

The method according to the invention is characterized as follows: the data of the book to be bound in the desired format is acquired and entered in a software, and then cataloged, the individual elements of the book cover based on this data input are cut to a size corresponding to the format, the alignment for the cut is selected by accordingly adjusting the mutually allocated cutting blades, the covering materials adapted to the format of the book covers and spine inlays are provided with glue, the glued covering material is fixed on its outer side, transferred and rolled onto the format-specific positioned paperboards (book boards) and machine boards (spine inlays), the individual elements of the book cover that are bonded to the covering material by gluing are suctioned up together and transported by turning to the corner bending station, then the endpaper is applied to the book covers in the machine, the end paper is cut to size as a connection between the text block and book cover to support the headbands and is transferred by thermal sealing and as an entire unit positionally precisely onto the book cover and simultaneously the crease of the covering material is formed, and a hollow space is formed toward the spine inlay, for compensation of the tensions occurring between the text block and the cover when the book is closed.

It is assumed that blanks, i.e. covering materials or rolled goods are used from a magazine. The stack of blanks includes diverse designs and dimensions of covering materials, preferably in DIN format, each of which features an identification key in the form of a data set, a production number, etc. These data are entered and stored in the computer along with the incoming order and include all relevant data for the book to be bound, including the DIN format. The data are entered in the software, cataloged and retrieved with the identification key in the computer as needed. These data individually specify and accompany the entire process for each blank and for each book cover, etc. and every part to be bound with the book cover contains these data. The identification key for the data can be embodied for example as a barcode, an RFID identification element, a marking, etc. and can be allocated to each sub-element and each process step.

The input of the data for the production of the book cover in the software preferably already takes place at the time of order placement. The data relate to the dimensions of the cover, the covering material, the endpaper, etc. These data are cataloged and integrated as a data marking in the book cover, so that they accompany the book cover on its route through the individual stations and are retrieved for preparation of each processing step, to control and coordinate the required precise settings and feeding of the individual elements, the adjustment and activating of the cutting blades, the application of glue, the placing of the desired covering material, the folding of the corners and edges, the supply, feeding and placing of the endpaper, etc. Optionally, the cutting of the book cover to a variable size can be carried out by a separate, external program step, for example in a separate loop of the production process, if special circumstances or reasons exist for this. In commercially available machines for the production of individual books and short runs, the book covering materials have been printed so far only using digital machines on a constant paper format, in which case the book covering materials have to be adapted corresponding to the dimensions of the book. This means that the blank sizes of the digital machines have to be adapted when changing form a book with a particular format to a book with a different format or other dimensions. In the case of very small editions or individual volumes, this results in significant expenditure of material and labor, so that the required time and costs are so high that production of individual books is not profitable.

By way of contrast, the method and device according to the invention require no intervention in the production process to change the format of the book cover, the covering materials and the endpapers, since the individual stations and their interplay automatically adapt the variable dimensions of the book cover to be manufactured with each cycle of the production process.

The invention therefore enables the economical production of individual books, especially of photo books, with variable cover printing and short runs, which conform to the quality of hand crafted books and which in the case of individual production and also of short runs can be manufactured in a manner that is both simple and profitable, since each book cover is a unique item, in which the text block, book cover and cover material are produced on the basis of the same data from the software.

In the following, the invention is described based on an exemplary embodiment with reference to the drawings:

DETAILED DESCRIPTION OF THE INVENTION

Figure 1:
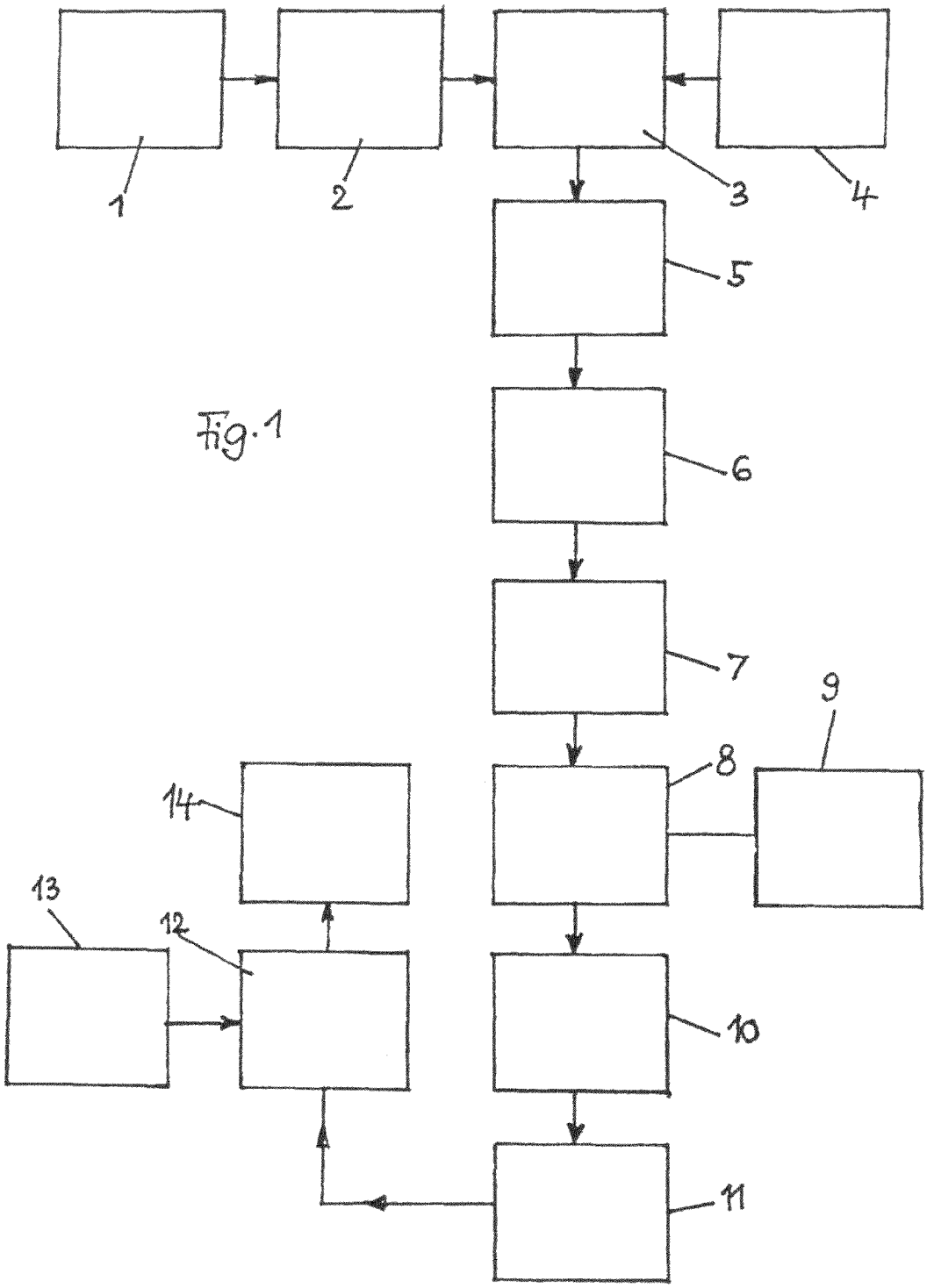
FIG. 1 shows in the form of a block diagram the process according to the invention in the form of the consecutive work steps for the mechanical production of book covers for individual books and short runs.

According to FIG. 1, in processing step 1 the data for the respective book cover of the book to be bound are acquired at the time of order placement and in step 2 entered into the software and cataloged, so that this information is integrated in the book covering material in the form of markings, data for chips or data for RFID elements and can be retrieved at any time for execution of the processing steps. In processing step 3 the book covers are cut to the individually specified size. During this step, the book covers, which are taken at 4 from rolled goods or from sheet formats, are inserted either manually or automatically into the operating cycle corresponding to the print marks integrated on the book cover and fixed precisely on the cutting surface. The supply and feeding of the book covers is carried out for example by suction devices designed as parallel double belts, which position the book cover precisely based on the print marks in the book covers. For correct cutting, the book covers are positioned in step 5 on the cutting surface in alignment with corresponding rails and in step 6 are cut to size consecutively on the longitudinal sides and cross sides by the cutting blade units. In step 7, a glue coating is applied by means of a rotating top side gluing machine and the book cover thus coated with glue is provided at 8 with a covering material on the outer side of the cover and rolled by means of pressing rollers to the format-specific positioned book cover and spine inlay, so the covering material that is precisely fed from a magazine 9 can be rolled and bonded to the book cover by means of gluing in step 10. Afterwards, the book cover thus far completed is turned by means of suction holders or transfer rollers and the corners of the covering material and the edges are consecutively folded in step 11, and in step 12 the endpapers are applied, which are precisely placed by cutting and feeding at 12 onto the book cover by means of thermal sealing. The endpapers, which are cut to size from materials for back gluing of text blocks for the connection between the text block and the book cover and of back gluing material made of paper as supports for the headbands, can be inserted in the process in step 13 from outside, either manually or automatically. Afterwards, in step 14, the crease of the covering material and a hollow space toward the spine inlay are formed, for compensation of the tensions occurring between the text block and book cover during closing of the book. Then the completed book cover is set aside in step 15 and the text block is inserted in the book cover in step 16.

Figure 2:
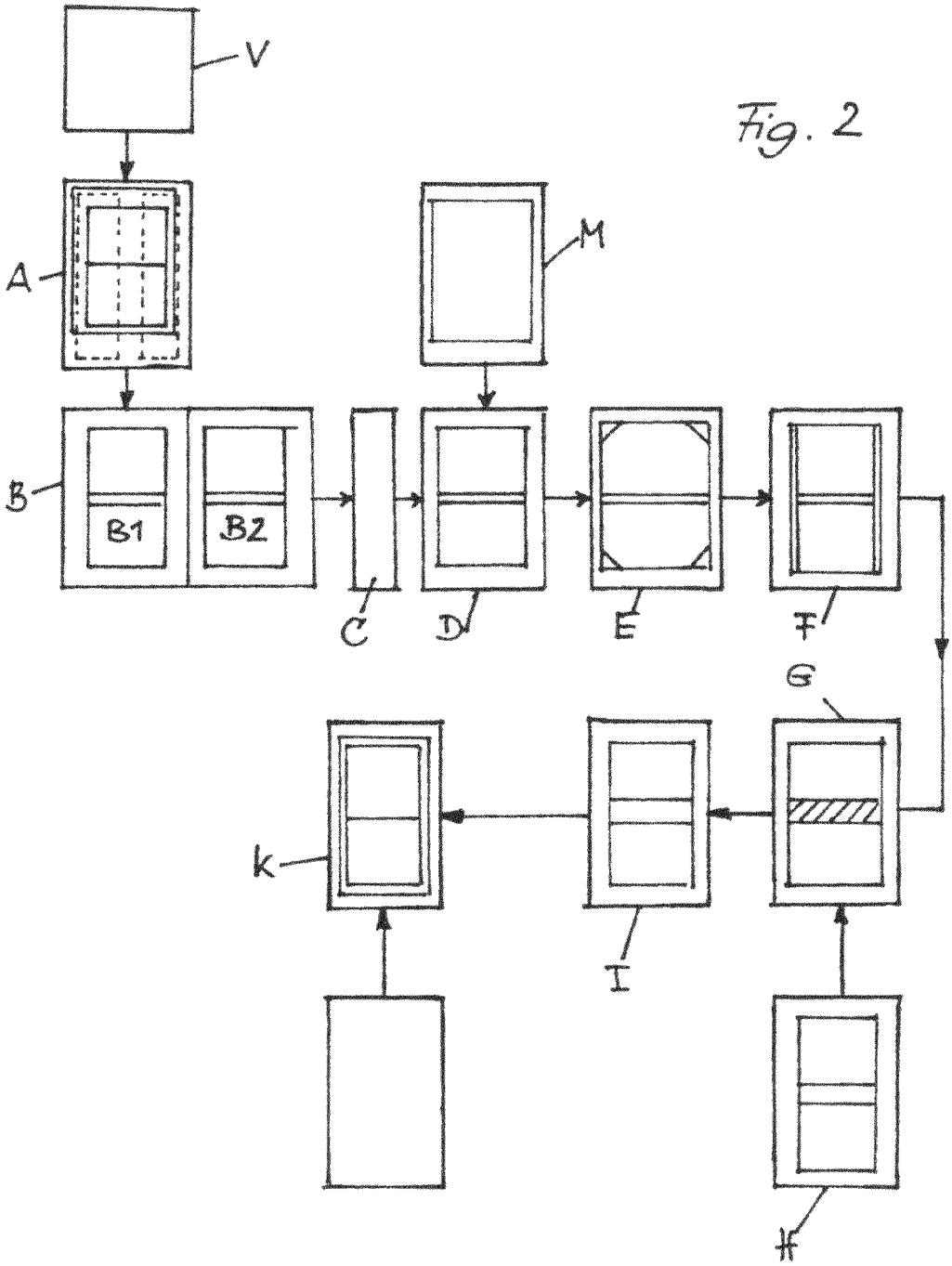
FIG. 2 shows in the form of a block diagram the individual stations in which the processing steps are carried out on the book covers with changing format sizes.

FIG. 2 shows in a block diagram the structural layout of the device according to the invention for automatic production of book covers for short runs with different format sizes. The data of the book covers to be produced, both for individual copies and for short runs with constantly changing format sizes, are entered with respect to the dimensions of the book cover, e.g. format blank, covering material, format size, etc. and the endpapers, etc. for each book into a software and retrieved during production by means of markings, print marks, etc. on the respective book cover. The unfinished covers or paperboards are provided in printed form from a supply station V, inserted in a station A and positioned for the cutting process. The insertion is carried out by a conveying device, on which the covers are fixed by suction, optionally by suction belts. From the feeding station A, the covers or paperboards are placed by means of the suction belts, etc. on the cutting table of the cutting station B and, precisely positioned, are cut to size consecutively by means of punching or cutting devices in the direction of width on two parallel sides in B1 and then in the longitudinal direction, likewise on two parallel sides in B2. The punching or cutting devices B1, B2 are preferably lowerable blades that are vertical to the cover surface and are equipped with switchable counter-blades for the respective front and back cut in one format direction; the exact cut of the two remaining format edges extending perpendicular to the first format direction is carried out by changing the direction of movement of the format in a second, practically identical cutting device.

The book board thus cut to size is transported further to a glue application station C, in which a rotating glue application roller is lowered onto the book board to apply glue to the cover surface or the spots to be provided with glue during rotation of the roller.

The book board provided with glue is transported beneath the glue application roller to the next processing station D, at which the spine inlay is joined with the book board. This spine inlay is optionally fed as a pre-cut part from a magazine M and placed manually onto the book board, or automatically fed from a magazine to the book board in the placing station and fixed on the outer side corresponding to the print covers by means of suction holders or transfer rollers, picked up and rolled onto the format-specific positioned book boards by means of pressing rollers. The individual elements of the book cover that are connected to the covering material by gluing are now suctioned up together and transported further. For further processing, the thus far completed book cover is turned in the corner folding station E and the corners are folded diagonally and then all four format edges are folded and glued by means of pre-heated pressing rails in the processing station F, so that the thus far prepared book covers in the machine can be provided directly with the endpapers.

This takes place in station G. The endpapers are made of materials for text block back gluing, namely of hinge material, Kraft paper or fabric and back gluing material made of paper as a support for the headbands. The entire endpapers are applied positionally precise to the book cover by thermal sealing. At the same time, the crease in the covering material is formed, leaving a hollow space for the spine inlay, for compensation of the tensions occurring between the text block and the cover during closing of the book. The endpaper is fed to station G in the form of a finished blank from an external supply station H and glued to the cover. Afterwards, the completed book cover is transported to the placing station I. The text block is inserted in a further station K.

What is claimed is:

1. A method for the software-controlled production of book covers for individual books and short runs with changing format sizes, each of the book covers comprising a text block, covers and a covering material manufactured based on identical data, wherein the method of manufacturing the book covers comprises:

a) acquiring data of a book to be bound in a desired format and entering the data in a software program, b) cataloguing the data, c) cutting the covers, the text block, and the covering material to a size corresponding to a format in a software-controlled process based upon the data of the book to be bound, d) aligning the cut adjusting mutually allocated cutting blades, e) adapting the covering material provided with glue to the format of the covers and spine inlays, f) fixing the covering material on an outer side onto the format-specific positioned covers and the format-specific spine inlays by gluing, h) suctioning up the covers and the covering material together and transporting the covers and the covering material, i) applying an endpaper to the format-specific book covers, j) cutting the endpaper to size with the cut adjusting mutually allocated cutting blades as a connection between the text block and the book cover to support headbands, k) transferring the endpaper and the text block by thermal sealing as an entire unit precisely onto the book cover and simultaneously forming a crease in the covering material, and l) forming a hollow space on the format-specific spine inlay for compensation of tensions occurring between the text block and the book cover when the book is closed.

2. The method according to claim 1, wherein a selected cover is bonded to a corresponding the covering material by means of thermal sealing and that a bonding force between the text block and the book cover is increased by thermal sealing of the endpapers.

3. The method according to claim 1, including the steps of cutting a blank for the cover, spine inlays and covering materials within the book cover making machine and controlling a cutting machine by controlling an input and output of data.

4. The method according to claim 3, wherein the book cover is cut to a variable size from sheets or rolled goods, using cutting blades in the cutting machine for longitudinal and cross cuts of single sheets equipped with switchable counter-blades, so a required front and back and top and bottom format cut for manufacturing an end format can be achieved with only one main blade and two counter-blades.

5. The method according to claim 1, wherein corners of the covering materials are folded by automatically adjusting corner folding tools for variable format sizes.

6. The method according to claim 5, wherein folding of upper and lower format edges of the covering materials is carried out for variable format sizes by heatable tools.

7. The method according to claim 1, wherein for insertion of a pre-manufactured endpaper, a crease of the covering material is formed, and a hollow space remains toward the spine inlays for compensation of tensions arising between the text block and the paperboard during closing of the book.

* * * * *